US011795018B2

(12) United States Patent
Wu et al.

(10) Patent No.: US 11,795,018 B2
(45) Date of Patent: Oct. 24, 2023

(54) PRINTING DEVICE WITH DOCUMENT MANAGING FUNCTION AND DOCUMENT MANAGING METHOD THEREOF

(71) Applicant: PRIMAX ELECTRONICS LTD., Taipei (TW)

(72) Inventors: Kun-Lin Wu, Taipei (TW); Fang-Hsuan Kuo, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 113 days.

(21) Appl. No.: 17/645,459

(22) Filed: Dec. 22, 2021

(65) Prior Publication Data

US 2023/0174330 A1 Jun. 8, 2023

(30) Foreign Application Priority Data

Dec. 2, 2021 (TW) ..... 110145062

(51) Int. Cl.
*B65H 31/30* (2006.01)
*B65H 31/34* (2006.01)
(Continued)

(52) U.S. Cl.
CPC ..... *B65H 7/14* (2013.01); *B41J 13/106* (2013.01); *B65H 5/062* (2013.01); *B65H 31/02* (2013.01); *B65H 31/30* (2013.01); *B65H 31/34* (2013.01); *B65H 31/36* (2013.01); *B65H 2513/10* (2013.01); *B65H 2553/41* (2013.01); *B65H 2601/10* (2013.01); *B65H 2801/03* (2013.01)

(58) Field of Classification Search
CPC ..... B65H 31/30; B65H 31/3009; B65H 31/3018; B65H 31/34; B65H 31/36; B65H 31/02; B65H 2513/10; B65H 2513/20; B65H 2553/41; B65H 2553/51; B65H 2601/10; B65H 29/68; B65H 29/125; B65H 37/04; B65H 7/14; B41J 13/106
See application file for complete search history.

(56) References Cited

U.S. PATENT DOCUMENTS 7,448,615 B2 * 11/2008 Takamura ..... B42C 1/12 270/58.11
7,874,551 B2 * 1/2011 Iguchi ..... B65H 31/3081 270/58.11

(Continued)

FOREIGN PATENT DOCUMENTS

JP 2000143055 A * 5/2000

*Primary Examiner* — Luis A Gonzalez
(74) *Attorney, Agent, or Firm* — WPAT, P.C

(57) ABSTRACT

A document managing method for a printing device is provided. The document managing method includes the following steps. Firstly, a printing mechanism prints a document with plural papers, and transfers the plural papers to a paper collection platform. Then, a management module manages the plural papers from two lateral sides of the plural papers. Then, a paper ejection module ejects a first portion of the plural papers at a first speed, and then ejects a second portion of the plural papers at a second speed. Consequently, the plural papers are exited from the paper collection platform. Then, the management module is separated from the two lateral sides of the plural papers, so that the plural papers fall down to a supporting tray. The first speed is faster than the second speed.

12 Claims, 5 Drawing Sheets

(51) Int. Cl.

| | |
|---|---|
| ***B65H 7/14*** | (2006.01) |
| ***B41J 13/10*** | (2006.01) |
| ***B65H 5/06*** | (2006.01) |
| ***B65H 31/02*** | (2006.01) |
| ***B65H 31/36*** | (2006.01) |

(56) References Cited

U.S. PATENT DOCUMENTS

| | | | | |
|---|---|---|---|---|
| 9,586,781 | B2 * | 3/2017 | Sekigawa | B65H 31/26 |
| 2013/0234384 | A1 * | 9/2013 | Wang | B65H 37/04<br>270/58.08 |
| 2020/0247152 | A1 * | 8/2020 | Nakazawa | B65H 37/04 |
| 2021/0039911 | A1 * | 2/2021 | Kotani | B65H 31/3027 |

* cited by examiner

PRINTING DEVICE WITH DOCUMENT MANAGING FUNCTION AND DOCUMENT MANAGING METHOD THEREOF

FIELD OF THE INVENTION

The present invention relates to a printing device with a document managing function and a document managing method for the printing device, and more particularly to a printing device and a document managing method capable for ejecting papers at two different speeds and orderly managing the ejected papers in a stack.

BACKGROUND OF THE INVENTION

A printer is one of the common and popular computer peripheral devices. For example, the general household printers or the office machines that have the printing function and are used in companies, institutions or schools can print out the documents for the users. Consequently, printers become indispensable devices for modern people when the paper processing tasks are performed.

With the development of science and technology, the functions of current printers or office machines are becoming more and more diverse. In addition to general printing functions, the printers or office machines provide other functions such as scanning, storing and transmitting functions. In order to provide better paper output effects, more relevant printing devices are equipped with additional functions e.g., the functions of stapling and managing documents. According to the relevant product developers, this type of printing device is referred as a staple finisher.

For example, in case that the printing device has the document managing function, a clip-shaped management module with a specified width is installed at a paper outlet of the printing device. For example, a document contains plural papers. After the papers are sequentially printed, the papers are successively transferred to a paper collection platform behind the paper outlet and slid to a back plate of the paper collection platform. In addition, these papers are successively contacted with the back plate and put close to each other. Consequently, the front-and-back alignment of all papers can be achieved. Then, the management module is horizontally moved relative to the two lateral sides of the paper outlet to allow the papers to be close to each other. Consequently, the left-and-right alignment of all papers can be achieved.

The printing device further comprises a stapling module. The stapling module is located beside the paper collection platform. After all papers of the document are managed, a corner of the stack of papers is stapled by the stapling module. Then, the document is ejected by a paper ejection module, which is located at an end of the paper collection platform. Then, the left and right sides of the management module are opened, and the document falls down to a supporting tray under the paper outlet. Consequently, the process of outputting one document is completed.

As mentioned above, the stapling function needs to cooperate with the managing function. After the papers are managed, the papers can be aligned with each other and stapled. In accordance with another design, the stapling function is not used. If the user intends that the printed document is not stapled or the printing device has the managing function only, the printing device performs the following operations. After the document is printed, the document (i.e., a stack of plural papers) is ejected from the paper collection platform by the paper ejection module.

After the document is ejected, the left and right sides of the management module are separated from each other. Consequently, the document falls down to the supporting tray.

In accordance with a design, plural rollers on the upper and lower layers of the paper ejection module are used to eject the papers. While the paper ejection operation is performed, the top side and the bottom side of the corresponding papers or document are clamped by these rollers. As the rollers are rolled quickly, the papers or document is ejected externally to the paper outlet. Consequently, the paper ejection operation is completed.

As mentioned above, the unstapled papers on the paper collection platform can be initially managed. However, due to the up-and-down engagement and quick rolling motion of these rollers, the papers are possibly ejected outwards with excessive forces. Consequently, these papers are disorderly stacked on the supporting tray. This problem may deteriorate the document output quality. Moreover, an excessively disordered stacking condition may adversely affect the paper sorting of the entire document and cause inconvenience to the user. On the other hand, if the papers are ejected at a low speed to avoid the disordered stacking condition of the papers, the time period of ejecting the papers is prolonged, or even the papers are unable to be completely exited from the paper collection platform.

SUMMARY OF THE INVENTION

The present invention provides a printing device with a document managing function and a document managing method for the printing device. The printed papers are ejected at two different speeds. After a portion of the papers is ejected out at a higher speed, the paper ejection module is immediately switched to a slower speed to eject the remaining portion of the papers. Since the speed of ejecting out the papers is not too fast, the disorderly stacked condition can be avoided. In addition, since the speed of ejecting out the papers is not too slow, the papers can be completely ejected out. By using the document managing method and the printing device of the prevent invention, the papers ejecting effect is optimized. Consequently, the ejected papers are orderly stacked, and the document output quality is enhanced.

In accordance with an aspect of the present invention, a document managing method for a printing device is provided. The printing device includes a printing mechanism, a paper collection platform, a management module, a paper ejection module and a supporting tray. The paper collection platform has a platform length. The document managing method includes the following steps. Firstly, the printing mechanism prints a document with plural papers, and transfers the plural papers to the paper collection platform. Then, the management module manages the plural papers from two lateral sides of the plural papers. Then, the paper ejection module ejects a first portion of the plural papers at a first speed, and then ejects a second portion of the plural papers at a second speed. Consequently, the plural papers are exited from the paper collection platform. Then, the management module is separated from the two lateral sides of the plural papers, so that the plural papers fall down to the supporting tray. The first speed is faster than the second speed. A first length of the first portion is larger than a second length of the second portion. The sum of the first length and the second length is equal to the platform length.

In accordance with another aspect of the present invention, a printing device with a document managing function is provided. The printing device includes a printing mechanism, a paper collection platform, a management module, a paper ejection module and a supporting tray. A document with plural papers is printed and transferred by the printing mechanism. The paper collection platform is located over the printing mechanism. The plural papers from the printing mechanism are supported on the paper collection platform, and the paper collection platform has a platform length. The management module is located at two lateral sides of a front of the paper collection platform. The plural papers are managed by the management module. The paper ejection module is located at an end of the paper collection platform. The paper ejection module is first operated at a first speed to eject a first portion of the plural papers, and then the paper ejection module is operated at a second speed to eject a second portion of the plural papers. Consequently, the plural papers are exited from the paper collection platform. The supporting tray is located under the management module. After the management module is separated from two lateral sides of the plural papers and the plural papers fall down, the plural papers are supported by the supporting tray. The first speed is faster than the second speed. A first length of the first portion is larger than a second length of the second portion. A sum of the first length and the second length is equal to the platform length.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
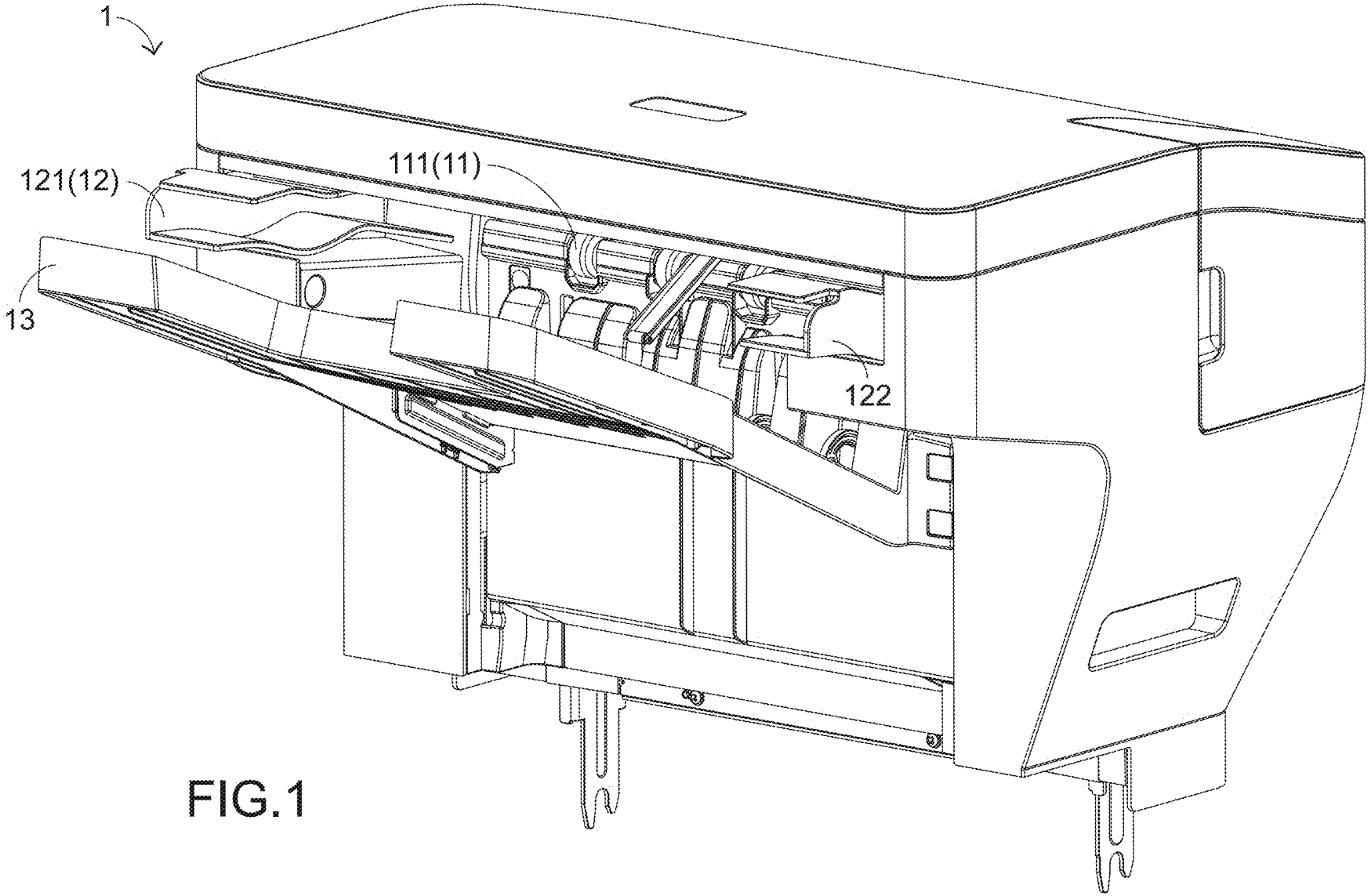
FIG. 1 is a schematic perspective view illustrating a printing device according to an embodiment of the present invention.
Figure 2:
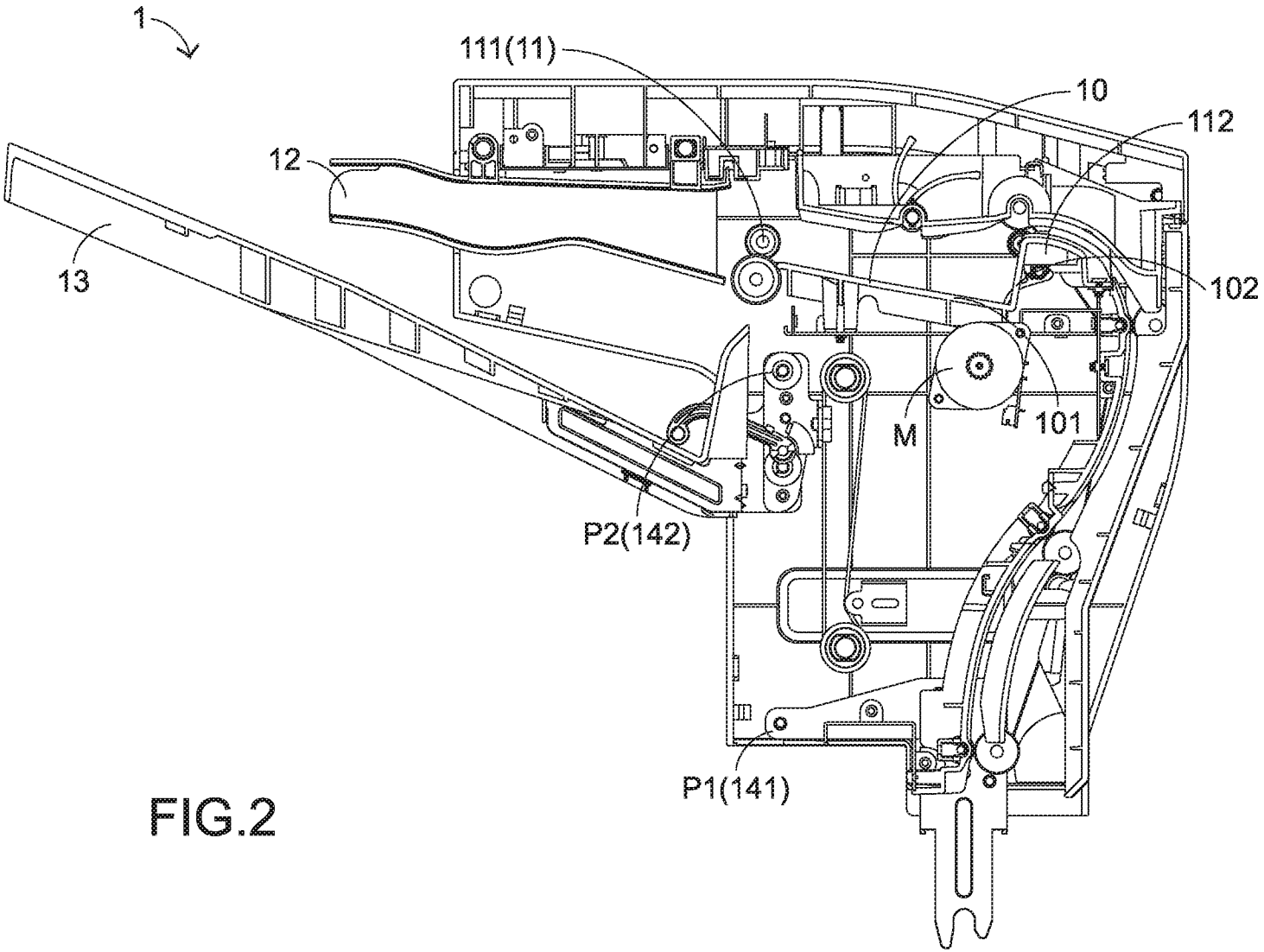
FIG. 2 is a schematic lateral cross-sectional view of the printing device according to the embodiment of the present invention.

The present invention provides a printing device with a document managing function and a document managing method for the printing device. Please refer to FIGS. 1 and 2. FIG. 1 is a schematic perspective view illustrating a printing device according to an embodiment of the present invention. FIG. 2 is a schematic lateral cross-sectional view of the printing device according to the embodiment of the present invention. As shown in FIGS. 1 and 2, the printing device 1 principally comprises a paper collection platform 10, a management module 12, a paper ejection module 11 and a supporting tray 13. The paper collection platform 10 is disposed within a casing of the printing device 1. The locations of the management module 12 and the paper ejection module 11 correspond to the paper outlet of the printing device 1. The supporting tray 13 is located outside the casing of the printing device 1.

The printing device 1 further comprises a printing mechanism (not shown). The printing mechanism is a modular mechanism. The printing mechanism comprises a printing element, a toner cartridge and a paper cassette. The printing mechanism is installed in the lower-half portion of the printing device 1. The printing mechanism is assembled with the paper collection platform 10, the management module 12 and the paper ejection module 11, which are installed in the upper-half portion of the printing device 1.

After a paper is printed by the printing mechanism, the paper is transferred to the paper collection platform 10. The paper collection platform 10 is located over the printing mechanism for supporting the corresponding paper. The management module 12 is located at the two lateral sides of the front of the paper collection platform 10 in order to manage the corresponding paper. The paper ejection module 11 is located at an end of the paper collection platform 10 in order to eject the corresponding paper from the paper collection platform 10. The supporting tray 13 is located under the management module 12 in order to support the paper that falls down from the management module 12.

Please refer to FIGS. 1 and 2 again. The paper collection platform 10 comprises an inclined plate 101 and a back plate 102. Moreover, the back plate 102 is located behind and connected with the inclined plate 101. In an embodiment, the management module 12 comprises two clamping parts 121 and 122, which are respectively located at the left side and the right side. Moreover, the two clamping parts 121 and 122 are movable relative to the paper collection platform 10 along the horizontal direction. In an embodiment, the paper ejection module 11 comprises plural rollers 111 and a motor M. The plural rollers 111 are arranged in an upper row and a lower row. The motor M is linked with the plural rollers 111 to drive the rolling motion of the plural rollers 111. Consequently, the plural rollers 111 can be contacted with and rolled on the top side and the bottom side of the papers that are supported on the paper collection platform 10.

The hardware components of the printing device 1 are similar to those of the conventional printing device. In accordance with a feature of the present invention, the document managing method of the present invention is executed by a firmware component that is installed in the printing device 1. Alternatively, the document managing method is written as operation program codes and stored in a flash memory of the printing device 1. After the operation program codes are accessed and executed by an associated controller or processing unit (not shown), the document managing method is operated.

Figure 3:
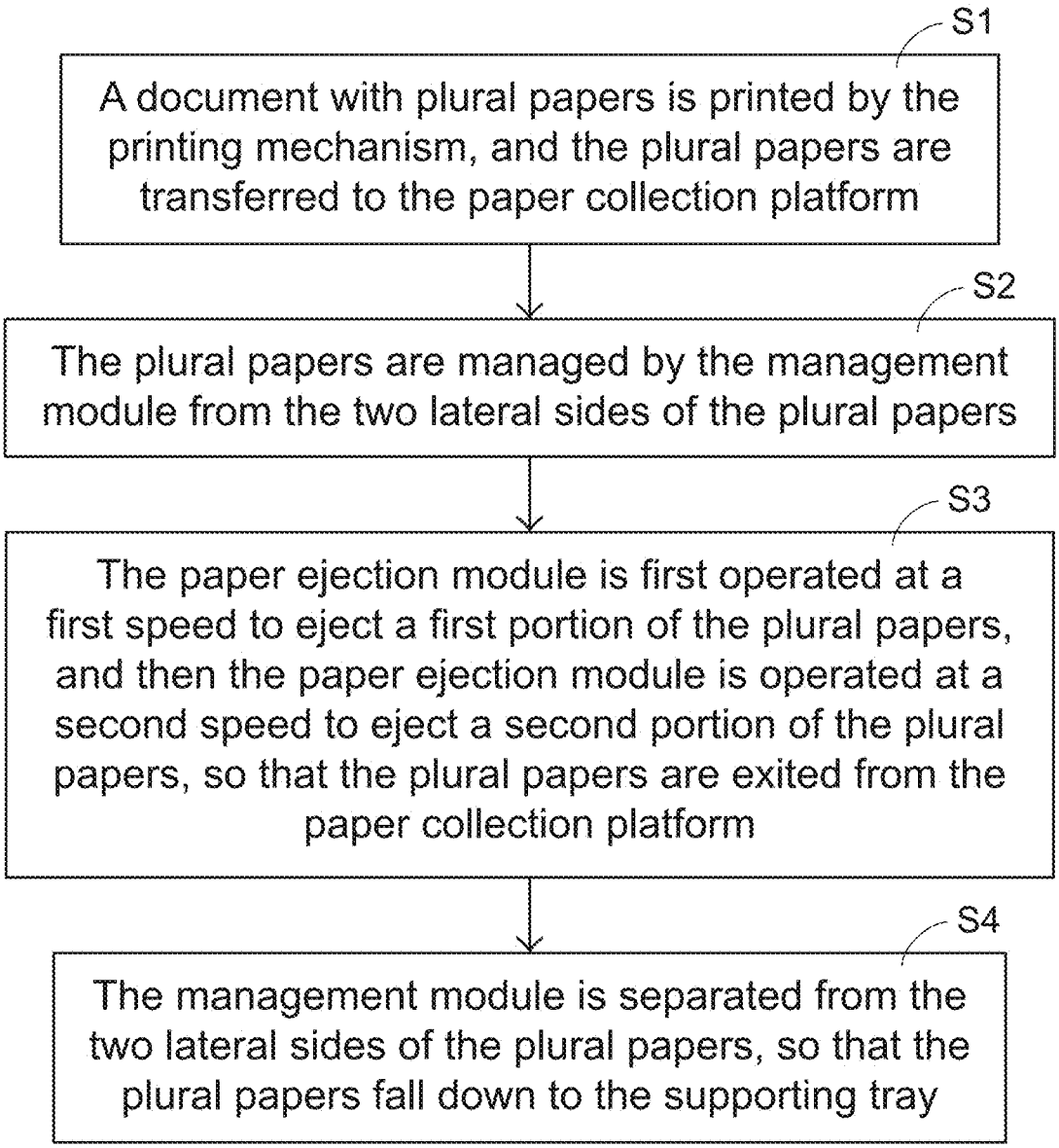
FIG. 3 is a flowchart of a document managing method for a printing device according to an embodiment of the present invention.
Figure 4:
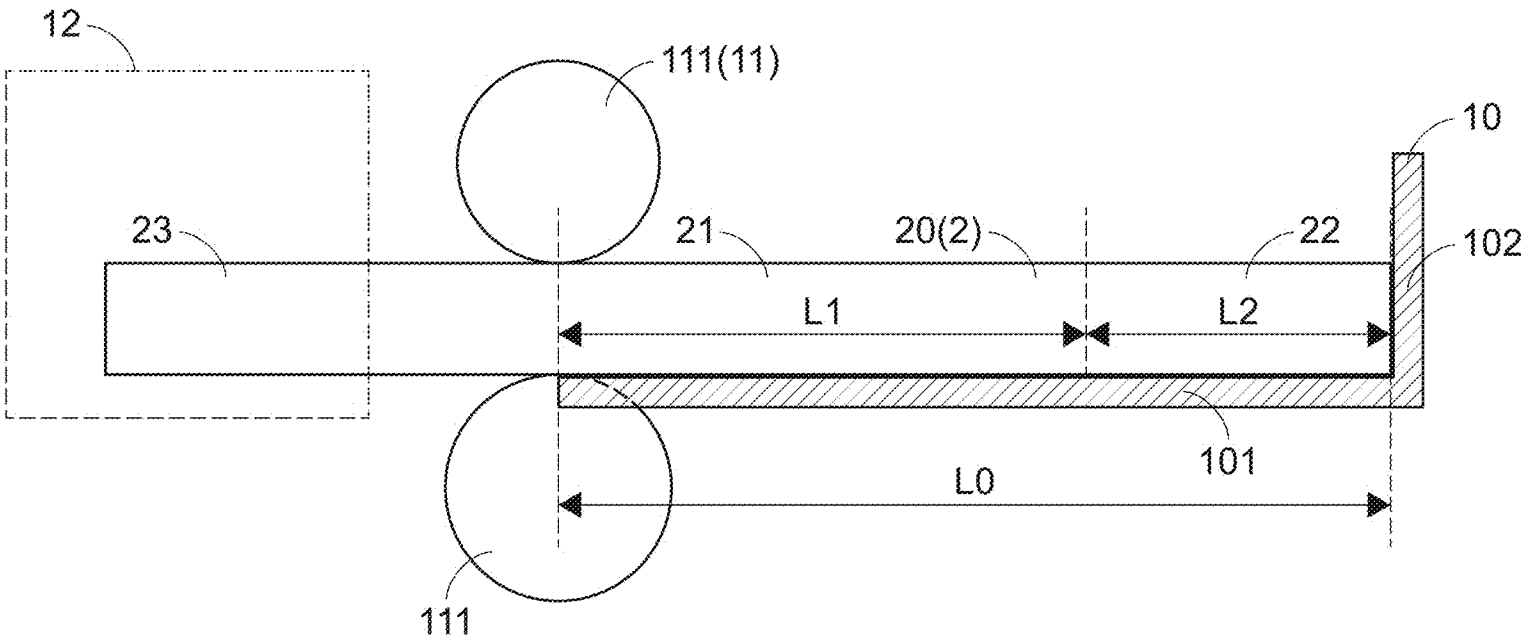
FIG. 4 is a schematic enlarged view illustrating the paper ejecting operation performed by the paper ejection module of the printing device according to the embodiment of the present invention.

Please refer to FIGS. 3 and 4. FIG. 3 is a flowchart of a document managing method for a printing device according to an embodiment of the present invention. FIG. 4 is a schematic enlarged view illustrating the paper ejecting operation performed by the paper ejection module of the printing device according to the embodiment of the present invention.

In this embodiment, the stapling function for the printed document is disabled, or the printing device is only provided with the managing function but is not provided with the stapling function. The document managing method will be described as follows.

Please refer to FIG. 3. Firstly, in a step S1, a document 2 with plural papers 20 is printed by the printing mechanism, and the plural papers 20 are transferred to the paper collection platform 10. Then, in a step S2, the plural papers 20 are managed by the management module 12 from the two lateral sides of the plural papers 20. In a step S3, the paper ejection module 11 is first operated at a first speed to eject a first portion 21 of the plural papers 20, and then the paper ejection module 11 is operated at a second speed to eject a second portion 22 of the plural papers 20. Consequently, the plural papers 20 are exited from the paper collection platform 10. Afterwards, in a step S4, the management module 12 is separated from the two lateral sides of the plural papers 20. Consequently, the plural papers 20 fall down to the supporting tray 13.

In case that the document to be printed contains a single paper, the problems associated with the subsequent paper ejecting operation or the disorderly stacked condition will not occur. In other words, the steps S1 and S2 are applied to the printed document with plural papers. After the document 2 is printed, all of the paper sheets 20 of the document 2 are placed on the paper collection platform 10 and slid to touch the back plate 102 along the inclined plate 101. Due to the back plate 102, the front-and-back alignment of the plural papers 20 can be achieved.

Please refer to FIG. 4. In an embodiment, the paper collection platform 10 has a platform length L0. The paper size of the document 2 is not restricted as long as the paper length is larger than the platform length L0. Meanwhile, the first portion 21 and the second portion 22 of the plural papers 20 are supported on the paper collection platform 10. A front portion 23 of the plural papers 20 is protruded outside the paper collection platform 10 and inserted into the region between the two clamping parts 121 and 122 of the management module 12. Then, the two clamping parts 121 and 122 of the management module 12 are horizontally moved to touch the two lateral sides of the plural papers 20. Consequently, the left-and-right alignment of all papers 20 can be achieved. Meanwhile, the plural papers 20 have been orderly managed.

In other words, the area of the entire document 2 (i.e., the plural papers 20) can be divided into three portions, i.e., the front portion 23, the first portion 21 and the second portion 22. The first portion 21 is arranged between the front portion 23 and the second portion 22. The first portion 21 has a first length L1. The second portion 22 has a second length L2. After the management of the document 2 is completed, the sum of the first length L1 and the second length L2 is equal to the platform length L0. That is, regardless of the paper size, the length of the portion of the paper retained on the paper collection platform 10 is equal to the sum of the first length L1 and the second length L2.

After the plural papers 20 are managed by the management module 12, the step S3 is performed. Due to the up-and-down engagement of the plural rollers 111, the plural papers 20 are correspondingly rolled. In this embodiment, the first speed is faster than the second speed, and the first length L1 of the first portion 21 is larger than the second length L2 of the second portion 22. In other words, the paper ejection module 11 is first operated at the faster speed to eject the plural papers 20 (i.e., the larger area of the papers 20), and then the paper ejection module 11 is operated at the slower speed to eject the plural papers 20 (i.e., the smaller area of the papers 20). In other words, the technology of the present invention is distinguished from the conventional technology of ejecting the entire document at a single fixed speed (regardless of the high speed or the low speed).

As mentioned above, the plural rollers 111 of the paper ejection module 11 are rolled to eject the papers. These rollers 111 are driven by the motor M. For controlling the ejecting speed of these rollers 111, the paper ejection module 11 further comprises a photo interrupter sensor 112 (see FIG. 2). For example, the photo interrupter sensor 112 is a rotary encoder. The photo interrupter sensor 112 is located beside the motor M for sensing the rotating speed of the motor M. That is, the photo interrupter sensor 112 senses the rotation of the rotating shaft of the motor M to generate a feedback signal. According to the feedback signal, the rotating condition of the motor M can be realized. In an embodiment, a revolution of the photo interrupter sensor 112 has 64 counts. The length of each count is equal to 0.1309 mm. According to the rotation distance and the rotating time, the rotating speed of the motor M can be calculated. Consequently, the rolling speed of the plural rollers 111 can be controlled to be the first speed or the second speed.

In an embodiment, the platform length L0 of the paper collection platform 10 is equal to 108.78 mm. The platform length L0 is a fixed value. Moreover, the first speed and the second speed are previously determined or adjusted. Consequently, the total paper ejecting time of the printing device 1 is not larger than the total paper ejecting time of the conventional printing device.

Figure 5:
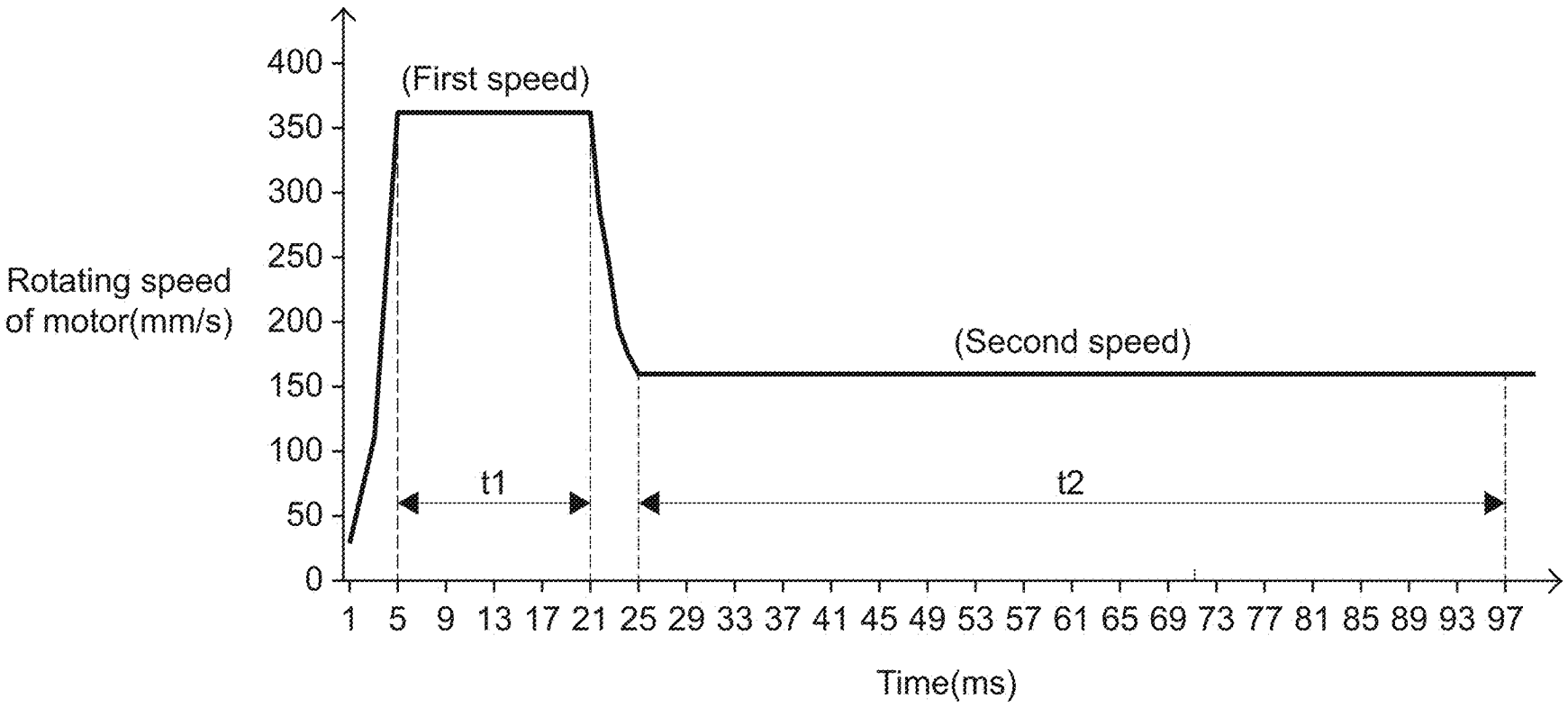
FIG. 5 is a plot illustrating the relationship between the rotating speed of the motor of the paper ejection module of the printing device and the operating time according to an experiment result.

FIG. 5 is a plot illustrating the relationship between the rotating speed of the motor M of the paper ejection module of the printing device and the operating time according to an experiment result. For example, the first speed is 362 mm/s, and the second speed is 160 mm/s. As shown in FIG. 5, the rotating speed of the motor M (i.e., the rolling speed of the rollers 111 or the paper ejecting speed) is accelerated from the zero speed to the first speed in a very short time and maintained at a constant speed (i.e., the first speed) for a first time period t1. Then, the rotating speed of the motor M is decreased to the second speed and maintained at a constant speed (i.e., the second speed) for a second time period t2. The first time period t1 is shorter than the second time period t2.

According to the calculation result, the first portion 21 with the first length L1 (e.g., 60 mm) is ejected by the rollers 111 at the first speed, and the second portion 22 with the second length L2 (e.g., 48.78 mm) is ejected by the rollers 111 at the second speed. In other words, after the papers are ejected by the rollers 111 for the length of 60 mm at the first speed according to the sensing and calculating results, the rolling speed of the rollers 111 is decreased and remaining papers (e.g., the second portion 22) are ejected by the rollers 111 at the second speed.

As mentioned above, the time period of increasing the zero speed to the first speed is very short, e.g., about 5 milliseconds (ms). Although the paper ejecting speed in this time period is not the high speed (i.e., the first speed), the ejected length is not too long (e.g., shorter than 1 mm). Moreover, the transient time period of switching the first speed to the second speed is very short, e.g., about 4 milliseconds (ms). Since the speed is switched continuously, the rollers 111 are rolled at a speed between the first speed and the second speed to eject the papers during the transient time period of switching the first speed to the second speed. However, on average, the first portion 21 is ejected at the higher speed (i.e., the first speed), and the second portion 22 is ejected at the lower speed (i.e., the second speed).

For assuring that all of these papers 20 are completely ejected out of the paper collection platform 10, the document managing method of the present invention can be further modified. For example, a variant example of the document managing method will be described as follows. After the rolling distance of the rollers 111 reaches the platform length L0, the rollers 111 are continuously rolled for a predetermined time period. For example, the predetermined time period is 1.46 second (s). That is, even if it is confirmed that the papers 20 are detached from the paper collection platform 10 according to the above design of the paper ejecting speeds, the continuous rolling motion of the rollers 111 for the predetermined time period can avoid the jammed problem. In an embodiment, after the entire of the second portion 22 is completely ejected out of the paper collection platform 10 by the rollers 111, the rolling motion of the rollers 111 is not immediately stopped. Instead, the rollers 111 are continuously rolled at the second speed for the predetermined time period, and then the rolling motion of the rollers 111 is stopped.

For assuring that the plural rollers are rolled at the designated speed ratio or the designated speeds, the document managing method of the present invention can be further modified. For example, another variant example of the document managing method will be described as follows. If the photo interrupter sensor 112 senses that the rotating speed of the motor M or the rolling speed of the rollers 111 is lower than the first speed or the second speed within a predetermined time period, the operation of the motor M is stopped, and an erroneous message is generated. According to the erroneous message reported and displayed by the printing device, the user can realize that the paper ejection operation is stopped. Consequently, the possible abnormal condition can be avoided.

Moreover, for assuring that all of these papers 20 are completely ejected out of the paper collection platform 10, the document managing method of the present invention can be further modified. For example, another variant example of the document managing method will be described as follows. When the first speed and the second speed are determined, the remaining second length L2 is considered according to the characteristics of the rollers 111. For example, when the rollers 111 are rolled to engage the top side and the bottom side of the papers 20, the regions of the papers 20 in contact with the rollers 111 are slightly recessed because of the degree of the engagement. Consequently, the rollers 111 have a contact length. The magnitude of the contact length is related to the degree of the engagement. In addition, the magnitude of the contact length is also related to the material and the size of the rollers 111.

Generally, the rollers 111 need to have a sufficient contact area (or contact length) with respect to the papers 20 in order to effectively move the papers 20. In an embodiment, the contact length is shorter than the second length L2. In other words, if the determined second length L2 is shorter than or equal to the contact length, these rollers 111 are unable to effectively engage the papers 20 and eject the papers 20 at the second speed. In accordance with a design, the contact length is 45 mm, and the second length L2 is 48.78 mm. Consequently, the paper ejecting operation can be effectively done.

The operation of the step S4 will be described as follows. Generally, after the plural papers 20 are exited from the paper collection platform 10, the two clamping parts 121 and 122 of the management module 12 are still in close contact with the plural papers 20. That is, the plural papers 20 are still clamped in the region between the two clamping parts 121 and 122. Since the paper ejection module 11 is operated at two different speeds to eject the papers 20, the papers 20 in the region between the two clamping parts 121 and 122 are orderly managed or the papers 20 are not ejected to the region outside the two clamping parts 121 and 122. Then, the step S4 is performed to separate the two clamping parts 121 and 122 of the management module 12 from the two lateral sides of the plural papers 20. Consequently, these papers 20 fall down to the supporting tray 13 orderly.

In an embodiment, the supporting tray 13 is movable upwardly or downwardly relative to the management module 12. As shown in FIG. 2, the supporting tray 13 can be moved in the region between a first position P1 and a second position P2. In the situation of FIG. 2, the supporting tray 13 is located at the second position P2 near the management module 12, and the first position P1 is below the second position P2.

In an embodiment, the printing device 1 further comprises a first sensor 141 and a second sensor 142. The first sensor 141 and the second sensor 142 are respectively installed at the first position P1 and the second position P2 that the supporting tray 13 can be moved to. The first sensor 141 and the second sensor 142 are used to sense the first position P1 and the second position P2, respectively. When the supporting tray 13 is ascended to the topmost position (i.e., the second position P2), the ascending action of the supporting tray 13 is stopped according to the sensing result of the second senor 142. Whereas, when the supporting tray 13 is descended to the bottommost position (i.e., the first position P1), the descending action of the supporting tray 13 is stopped according to the sensing result of the first senor 141.

In accordance with another feature of the present invention, the movement of the supporting tray 13 is helpful to allow the papers 20 falling down to the supporting tray 13 to be orderly stacked. That is, the step S4 of falling down the papers 20 to the supporting tray 13 comprises the following sub-steps. While the papers 20 are ejected by the paper ejection module 11, the supporting tray 13 is moved downwardly in the direction toward the first position P1. After the papers 20 fall down to the supporting tray 13, the supporting tray 13 is moved upwardly to the second position P2.

Since the papers 20 are not stapled, the papers 20 may be scattered due to collision at the moment when they fall down to the supporting tray 13. If the number of the printed documents is too large, the clamping parts 121 and 122 are moved to the left and right sides alternately. Consequently, the plural document stacks can be distinguished from each other. Under this circumstance, the disorderly stacked condition becomes more serious. However, if the supporting tray 13 is correspondingly moved down to receive the falling papers 20, the degree of collision can be effectively offset. Moreover, if the designated print job is provided for plural documents, the supporting tray 13 can be moved down to make room for these documents. Consequently, the stack of the papers is not too high to block the paper outlet.

From the above descriptions, the present invention provides a printing device with a document managing function and a document managing method for the printing device. The printed papers are ejected at two different speeds. After a portion of the papers is ejected out at a higher speed, the paper ejection module is immediately switched to a slower speed to eject the remaining portion of the papers. Since the speed of ejecting out the papers is not too fast, the disorderly stacked condition can be avoided. In addition, since the speed of ejecting out the papers is not too slow, the papers can be completely ejected out. By using the document managing method and the printing device of the prevent invention, the papers ejecting effect is optimized. Consequently, the ejected papers are orderly stacked, and the document output quality is enhanced.

In other words, the printing device and the document managing method of the present invention are capable of effectively overcoming the drawbacks of the conventional technologies and achieving the purposes of the present invention.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A document managing method for a printing device, the printing device comprising a printing mechanism, a paper collection platform, a management module, a paper ejection module and a supporting tray, the paper collection platform having a platform length, the document managing method comprising steps of:

the printing mechanism printing a document with plural papers, and transferring the plural papers to the paper collection platform;

the management module managing the plural papers from two lateral sides of the plural papers;

the paper ejection module ejecting a first portion of the plural papers at a first speed, and then ejecting a second portion of the plural papers at a second speed, so that the plural papers are exited from the paper collection platform; and separating the management module from the two lateral sides of the plural papers, so that the plural papers fall down to the supporting tray, wherein the first speed is faster than the second speed, a first length of the first portion is larger than a second length of the second portion, and a sum of the first length and the second length is equal to the platform length; and wherein the paper ejection module comprises plural rollers, a motor and a photo interrupter sensor, wherein the motor drives the plural rollers, so that the plural rollers are contacted with and rolled on a top side and a bottom side of the plural papers, wherein the photo interrupter sensor senses a rotating speed of the motor, and a rolling speed of the plural rollers is controlled to be the first speed or the second speed according to a sensing result of the photo interrupter sensor.

2. The document managing method according to claim 1, wherein the plural rollers have a contact length, and the contact length is shorter than the second length.

3. The document managing method according to claim 1, wherein if the photo interrupter sensor senses that the rotating speed of the motor or the rolling speed of the plural rollers is lower than the first speed or the second speed within a predetermined time period, the motor is stopped, and an erroneous message is generated.

4. The document managing method according to claim 1, wherein after a rolling distance of the plural rollers reaches the platform length, the plural rollers are continuously rolled for a predetermined time period.

5. The document managing method according to claim 1, wherein the first portion and the second portion of the plural papers are supported on the paper collection platform, and a front portion of the plural papers is protruded outside the paper collection platform and inserted into the management module, wherein the first portion is arranged between the front portion and the second portion.

6. The document managing method according to claim 1, wherein the printing device further comprises a first sensor and a second sensor, the first sensor senses a first position, and the second sensor senses a second position, wherein the document managing method further comprises steps of:

while the plural papers are ejected by the paper ejection module, moving the supporting tray downwardly in a direction toward the first position; and after the plural papers fall down to the supporting tray, moving the supporting tray upwardly to the second position.

7. A printing device with a document managing function, the printing device comprising:

a printing mechanism, wherein a document with plural papers is printed and transferred by the printing mechanism;

a paper collection platform located over the printing mechanism, wherein the plural papers from the printing mechanism are supported on the paper collection platform, and the paper collection platform has a platform length;

a management module located at two lateral sides of a front of the paper collection platform, wherein the plural papers are managed by the management module;

a paper ejection module located at an end of the paper collection platform, wherein the paper ejection module is first operated at a first speed to eject a first portion of the plural papers, and then the paper ejection module is operated at a second speed to eject a second portion of the plural papers, so that the plural papers are exited from the paper collection platform; and a supporting tray located under the management module, wherein after the management module is separated from two lateral sides of the plural papers and the plural papers fall down, the plural papers are supported by the supporting tray, wherein the first speed is faster than the second speed, a first length of the first portion is larger than a second length of the second portion, and a sum of the first length and the second length is equal to the platform length;

wherein the paper ejection module comprises:

plural rollers;

a motor linked with the plural rollers to drive the plural rollers, so that the plural rollers are contacted with and rolled on a top side and a bottom side of the plural papers; and a photo interrupter sensor located beside the motor to sense a rotating speed of the motor, wherein a rolling speed of the plural rollers is controlled to be the first speed or the second speed according to a sensing result of the photo interrupter sensor.

8. The printing device according to claim 7, wherein the plural rollers have a contact length, and the contact length is shorter than the second length.

9. The printing device according to claim 7, wherein if the photo interrupter sensor senses that the rotating speed of the motor or the rolling speed of the plural rollers is lower than the first speed or the second speed within a predetermined time period, the motor is stopped, and an erroneous message is generated.

10. The printing device according to claim 7, wherein after a rolling distance of the plural rollers of the paper ejection module reaches the platform length, the plural rollers are continuously rolled for a predetermined time period.

11. The printing device according to claim 7, wherein the first portion and the second portion of the plural papers are supported on the paper collection platform, and a front portion of the plural papers is protruded outside the paper collection platform and inserted into the management module, wherein the first portion is arranged between the front portion and the second portion.

12. The printing device according to claim 7, wherein the printing device further comprises:

a first sensor located at a first position, wherein the supporting tray is movable to the first position, and the first position is sensed by the first sensor; and a second sensor located at a second position, wherein the supporting tray is movable to the second position, and the second position is sensed by the second sensor, wherein while the plural papers are ejected by the paper ejection module, the supporting tray is moved downwardly in a direction toward the first position, wherein after the plural papers fall down to the supporting tray, the supporting tray is moved upwardly to the second position.

* * * * *